US010006707B1

(12) United States Patent
Wiley et al.

(10) Patent No.: US 10,006,707 B1
(45) Date of Patent: Jun. 26, 2018

(54) PORTABLE WIG AND CAP DRYING STAND FOR USE WITH PORTABLE HAIRDRYER

(71) Applicants: James R. Wiley, Friendswood, TX (US); Carl A. Strong, Pearland, TX (US)

(72) Inventors: James R. Wiley, Friendswood, TX (US); Carl A. Strong, Pearland, TX (US)

( * ) Notice: Subject to any disclaimer, the term of this patent is extended or adjusted under 35 U.S.C. 154(b) by 359 days.

(21) Appl. No.: 14/690,418

(22) Filed: Apr. 18, 2015

(51) Int. Cl.

| | |
|---|---|
| ***A45D 20/12*** | (2006.01) |
| ***F26B 9/00*** | (2006.01) |
| ***A45D 44/14*** | (2006.01) |
| ***A45D 20/52*** | (2006.01) |
| ***F26B 25/00*** | (2006.01) |

(52) U.S. Cl.
CPC ..... *F26B 9/003* (2013.01); *A45D 20/52* (2013.01); *A45D 44/14* (2013.01); *F26B 25/00* (2013.01)

(58) Field of Classification Search
CPC .... A45D 44/02; A45D 44/14; A45D 2200/05; F26B 9/003
USPC ..... 34/96–101, 283; 219/222, 226; 392/313, 392/320
See application file for complete search history.

(56) References Cited

U.S. PATENT DOCUMENTS

| | | | | |
|---|---|---|---|---|
| D541,493 | S * | 4/2007 | Peet | D32/8 |
| 2007/0137060 | A1* | 6/2007 | Woodson | A45D 20/12 34/97 |
| 2007/0193059 | A1* | 8/2007 | Carey | A47L 23/205 34/229 |
| 2015/0075028 | A1* | 3/2015 | Agoro | A45D 20/46 34/509 |
| 2015/0230589 | A1* | 8/2015 | Davidson | A45D 44/14 223/66 |

* cited by examiner

*Primary Examiner* — John McCormack
(74) *Attorney, Agent, or Firm* — Karen B. Tripp

(57) ABSTRACT

A portable wig and cap drying stand for use with a portable electric hairdryer. The stand has a base which receives the bottom or fan section of the hairdryer and holds the nozzle of the hair dryer directed vertically away from the stand and towards a wig support. A hollow cylinder fits over the nozzle and connects the wig support to the base of the stand. The hairdryer is turned on for drying the wig or hat on the stand. When not in use, the stand may be compacted by removing or collapsing the cylinder, for portability and packability.

14 Claims, 4 Drawing Sheets

PORTABLE WIG AND CAP DRYING STAND FOR USE WITH PORTABLE HAIRDRYER

BACKGROUND

1. Field of the Invention

The present invention relates to accessories for handheld hair dryers, also called blow-dryers, for hair. The present invention also relates to devices useful for drying wigs and caps or hats.

2. Description of Relevant Art

Devices for ventilating and drying wigs are known. Typically, such devices are head shaped and have holes for ventilation purposes. One such example is taught in U.S. Pat. No. 4,184,398 to LaMont. LaMont provides a head shaped wig support with large holes for ventilation and suction cups for holding the device to a surface. LaMont teaches that forced air may be used to aid in the ventilation or drying of a wig on the support taught therein, but that such forced air is not necessary. When used, the forced air is directed to the wig via an elbow-like shaped member. Another example is taught in U.S. Patent Application Publication No. 2010/0163066A1 of Robinshtain. Robinshtain teaches a head shaped wig support with ventilation holes and a built in fan. The fan is intended to draw air into an intake hole from which the air is intended to flow up and out exit holes in the skull portion of the device.

The wig supports and dryers known in the art are typically bulky and expensive. Nevertheless, a means for holding a wig when the wig is not in use and for allowing a wig to have ventilation for general airing and for drying after washing is critical for wig longevity and enjoyment of use. Known prior art wig supports and dryers are particularly cumbersome for traveling, and usually are not realistically or readily packable for overnight air travel. A need exists for an efficient, economical, and portable/packable wig dryer.

SUMMARY

The present invention provides a portable stand for supporting a wig, cap or hat, for aeration and/or drying. The stand comprises a hollow base with legs that allow air flow beneath the base, a wig support having perforations for air flow, and a hollow cylinder for connecting the wig support to the base. The cylinder also preferably has perforations for air flow.

The portable stand of the invention is adapted for use with a portable hairdryer so that the hairdryer can be used to provide heated air to and through the stand to expedite drying of a wig positioned on the wig support of the stand. Any portable hairdryer having a base or bottom housing a fan, a nozzle, and a handle in a hand gun configuration may be used with the invention. Such hairdryer typically has an electric switch on the handle for turning the hairdryer on and off.

For use, the portable hairdryer's bottom housing the fan is positioned within the base of the stand of the invention such that the base holds the hairdryer in a position that causes the hairdryer nozzle to point away from the base and blow air in a direction away from the base. The cylinder fits over the hairdryer nozzle and connects the wig support to the base. For drying, a wig or cap is placed atop the wig support and the hair dryer is turned on to blow air up through the cylinder and the wig support and out the perforations in the wig support.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Hairdryers typically used today are relatively small, easy to pack and carry, and are commercially available in an assortment of sizes, strengths, and types. Most such hairdryers today, however, are hand-held and generally have a gun-shaped configuration. That is, such hairdryers have a base or bottom housing a fan, a nozzle for directing air flow, and a handle for holding the hair dryer, also commonly called a blow-dryer. These hairdryers are electrically driven and generally work by drawing air in through an intake, directing the air over heating coils, and then blowing the heated air out directionally through an exhaust nozzle. Typically, a user holds the hairdryer by the handle and directs its air flow at the hair to be dried.

The present invention works as an accessory for this type of portable, hand-gun style hairdryer or blow-dryer, and as used herein with respect to the invention, the term "hairdryer" shall mean this type of hairdryer. When used with such a hairdryer, the present invention provides a portable, packable means for quickly and easily drying a wig or cap.

Figure 1:
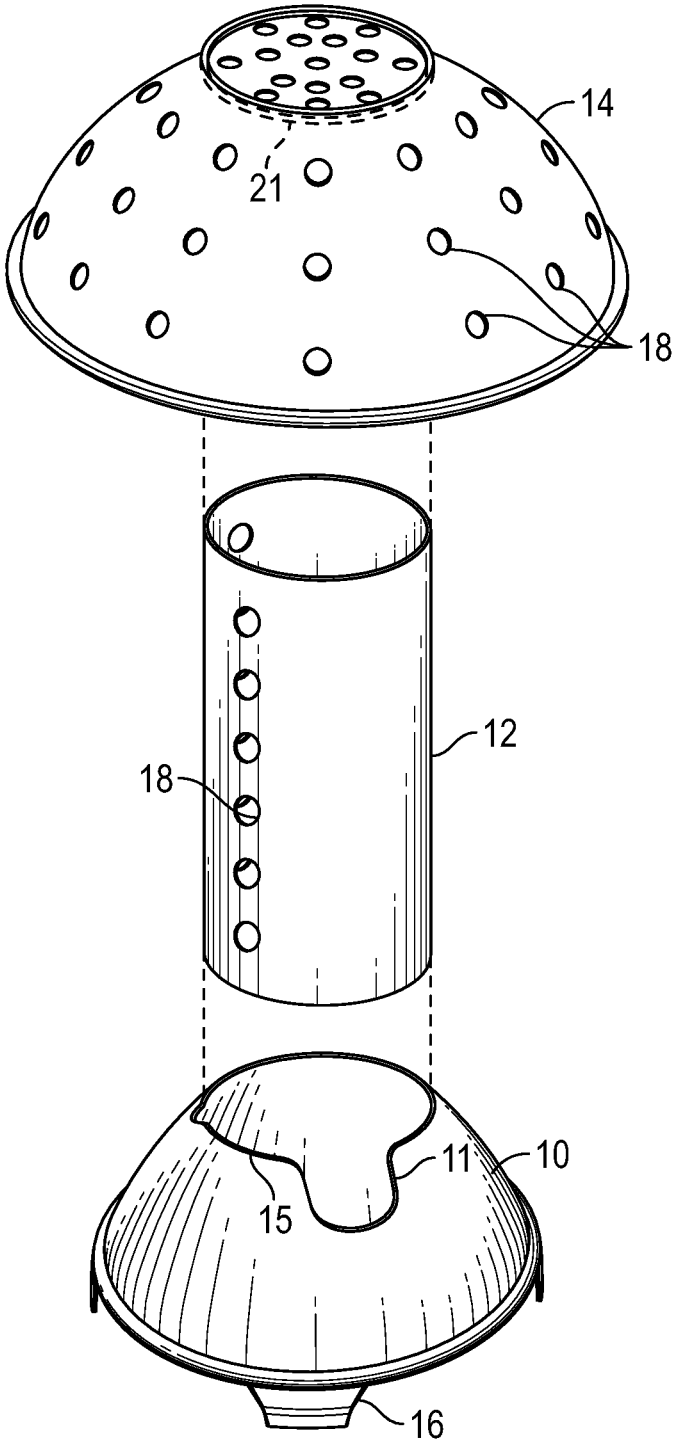
FIG. 1 is an exploded view of one embodiment of the wig or cap stand of the invention.
Figure 2:
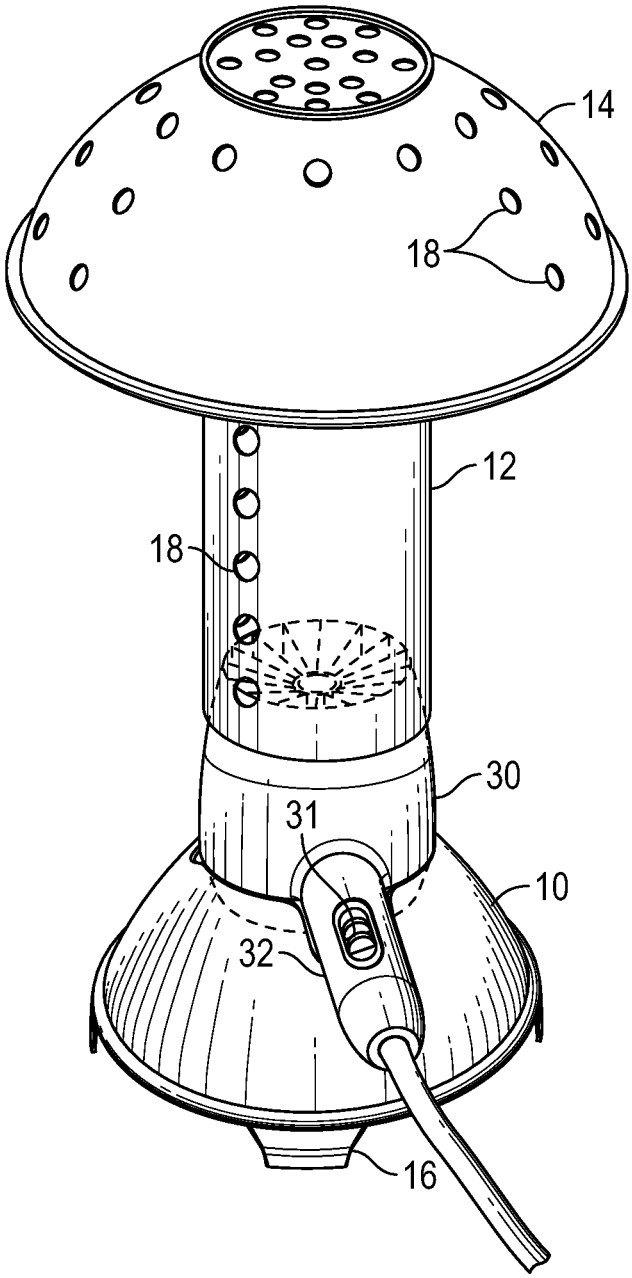
FIG. 2 is a perspective view of the embodiment of the wig or cap stand of the invention shown in FIG. 1, with a portable hairdryer in position in the stand for use.
Figure 5:
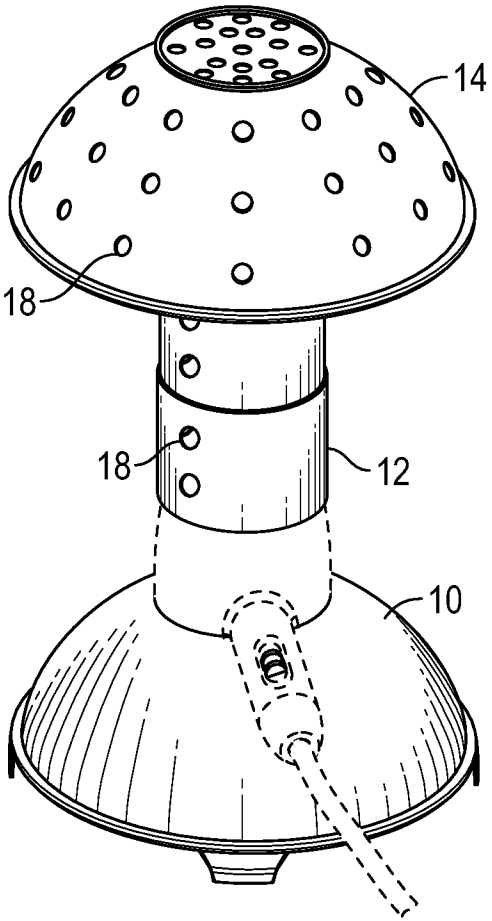
FIG. 5 is a perspective view of another alternative embodiment of the wig or cap stand of the invention, having a telescopic cylinder for collapsing when not in use.

This adaption of a hairdryer and use of the invention will be appreciated from referring to the Figures herein. FIG. 1 shows the three basic elements of the wig or cap stand of the invention—base 10, cylinder 12, and wig support 14. Base 10 is hollow for receiving at hole 15 the fan portion or bottom of the hairdryer housing the fan, as shown in FIG. 2. Cut-out 11 in one embodiment of the invention accommodates the handle 32 of the hairdryer 30, allowing the handle to partially fit in the base 10 and also extend outwardly from the base 10 exposing the electrical switch 31 on the hairdryer handle 32 for ease in turning the hairdryer 30 on and off. The hairdryer handle 32 may optionally rest on the base 10, as shown in FIG. 5, or rest on the cutout 11 in the base as shown in FIG. 2.

Figure 4:
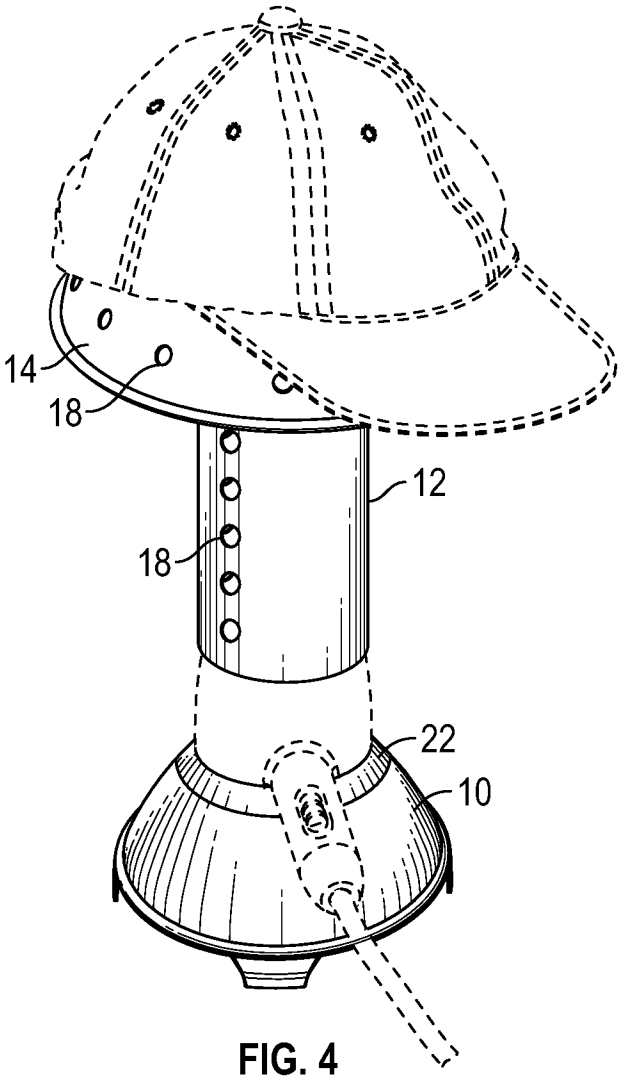
FIG. 4 is a perspective view of the embodiment of the wig or cap stand of the invention shown in FIG. 3, with a cap positioned thereon.
Figure 3:
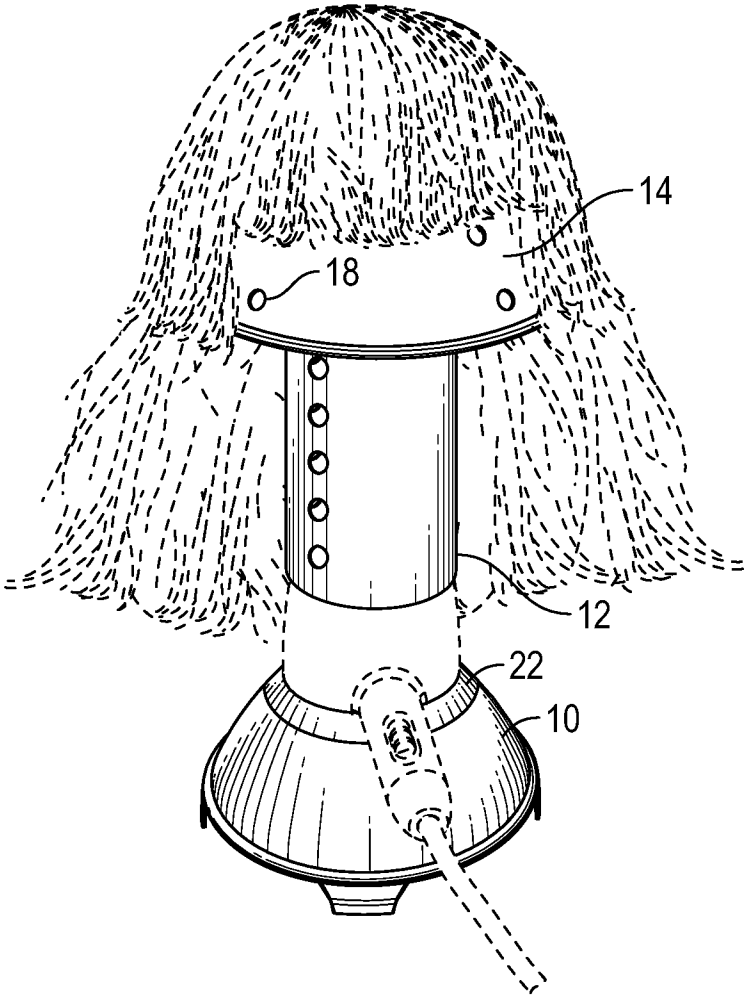
FIG. 3 is a perspective view of an alternative embodiment of the wig or cap stand of the invention, with a wig positioned thereon, and showing an adapter in the base for accommodating different sized portable hairdryers.

Base 10 is shown in the Figures as being bowl shaped for example, and other shapes could alternatively be used, such as for more non-limiting examples, a box-like shape or a pyramidal type shape. Base 10 should however, be sufficiently deep and broad with a hole 15 having a diameter sufficiently large to receive the bottom or fan section of a portable hairdryer or blow dryer. While such commercially available hairdryers are typically similar in shape and size, they nevertheless vary in shape and size. To accommodate such variances, base 10 may have an adapter 22 as shown in FIGS. 3 and 4 or may have the diameter of hole 15 large enough to accommodate most if not all such hairdryers commercially available. While hole 15 may be larger than needed for some hairdryers, a perfect or tight fit of the hairdryer into base 10 is not believed necessary. Adapter 22 may be comprised of a flexible natural or synthetic rubber, vinyl, silicone, or similar material that preferably has some give and also some resilience for adapting hole 15 for a better or tighter fit with the bottom of the hairdryer. Alternatively, adapter 22 might be comprised of the same or similar material as the base 10, with a fitting to snap in or out of the base for adjustment for various sizes of hairdryers.

The stand of the invention, and particularly base 10, cylinder 12, and wig support 14, may be made of any material which is relatively durable, able to withstand heat at temperatures achievable with and/or associated with a hairdryer, and also preferably light in weight. Various hard type plastics such as for non-limiting examples high-density polyethylene and acrylics are examples of such suitable materials for comprising the invention, being light in weight and contributing to the invention's portability and suitability for packing and travel. Ceramics are another non-limiting example of materials suitable for comprising the invention although ceramics are generally heavier and more easily broken than plastics and thus not as well-suited for portability. It is believed that when the hairdryer is positioned in base 10, the stand of the invention with the hairdryer will have sufficient weight as to be balanced so as not to easily or readily tip over when a wig or cap or hat is placed on the wig support 14 of the stand. That is, the hairdryer in the stand of the invention affords the stand sufficient weight for balance to support a wig or cap thereon without need for the stand itself to be comprised of a heavy material, or a heavier than hard plastic material, so long as the material comprising the stand of the invention is sufficiently strong as to be able to withstand the weight of the wig or cap without breaking or buckling when such wig or cap is wet and thus at its heaviest when placed on the stand.

Base 10 has legs 16 for holding base 10, and the hairdryer positioned in and being held in base 10, above the surface on which base 10 is sitting. Any planar surface would be suitable but most preferably the surface should be heat resistant and in any case not easily flammable since the hairdryer will give off heat in use. Legs 16, in one embodiment numbering about three or four, allow flow of air beneath base 10 and the stand of the invention for better operation of the hairdryer. Although shown in the Figures as legs projecting from the bottom of base 10, "legs" 16 could alternatively be vents in the sides of base 10 for accommodating and facilitating air flow to and from the hair dryer. As used herein, the term "legs" shall be understood to include such vents or any other similar means for effecting air flow to and from the hairdryer in the stand of the invention. Not shown, legs 16 might also be or have appended or appendable thereto suction cups for holding the stand to certain types of surfaces, usually smooth, such as glass or stainless steel. While it is contemplated that the invention will usually be used on a flat, horizontal surface with the nozzle of the hairdryer pointed vertically, as shown in FIGS. 2, 3, 4, and 5, an alternative embodiment can be appreciated where suction cups might hold the invention at an angle, such as a right angle with the nozzle pointing in a horizontal direction. The wig support might then be used as is, or adapted in shape or position.

Figure 6:
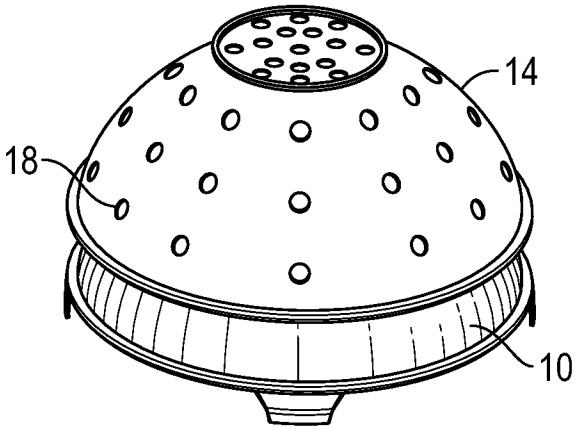
FIG. 6 is a perspective view of the wig or cap stand of the invention shown in FIG. 5, having the cylinder collapsed or removed, and the wig support and the base together for compact storage.

As shown in the Figures, wig support 14 has a hollow bowl like shape, with perforations 18 there through for air flow. Wig support 14 might alternatively have a dome shape. In some embodiments, wig support 14 may have a shape similar to base 10, particularly in the embodiments such as shown for example in FIG. 6 where wig support 14 fits over base 10 for compact storage when not in use. Such compact shape is most packable and portable as well. The width, depth, and overall size and even shape of wig support 14 should be such as to provide support for or to hold a wig for a human head or a cap or hat for a human head. Although human heads and thus wigs and caps and hats vary some in size, the fitting of the wig and/or cap and/or hat on support 14 is not expected to be precise and support 14 should preferably be a size and shape that will support most if not all wigs and caps and hats. Perforations 18 may be at various intervals over the entire surface of support 14 as shown in FIGS. 1, 5 and 6, or may only be on the portion of support 14 that will typically have a portion of a wig resting thereon, as shown in FIGS. 2 and 3. FIG. 3 for example does not show perforations in the wig support of the invention beneath the bangs of the example wig.

Support 14 has an internal groove 21 as illustrated in FIG. 1 at its top for receiving and grasping, gripping, or otherwise holding the top of hollow cylinder 12 in place. In one alternative embodiment of the invention, support 14 is permanently attached, as for non-limiting example, by gluing or molding to cylinder 12. In another embodiment not shown, cylinder 12 is removable from support 14 and foldable for compact storage and portability. In still another embodiment, shown for example in FIG. 5, cylinder 12 is collapsible, for compact storage as shown in FIG. 6. Cylinder 12 in FIG. 5 achieves collapsibility by a telescoping design, but other means for collapsing might be used. Cylinder 12 might also be removed for compact storage as shown in FIG. 6.

In use, cylinder 12 will extend downward from support 14 toward base 10, as shown in FIG. 1. The diameter and length of cylinder 12 should be such as to fit over the nozzle of the hairdryer—over at least the nozzle of most commercially available hairdryers. The end of cylinder 12 distal from support 12 and proximal to base 10 may rest on the body of the hairdryer protruding from base 10, as shown in FIGS. 2, 3, 4, and 5, or may extend down over the body of the hairdryer to rest on base 10. Cylinder 12 will have some perforations there through, but preferably only on a side or portion of cylinder 12 so as to better direct air flow toward support 14 while still allowing air flow for better operation of the hair dryer.

The discussion of any reference herein is not an admission that the reference is prior art to the present invention, especially any reference that may have a publication date after the priority date of this application. At the same time, each and every claim below is hereby incorporated into this detailed description or specification as additional embodiments of the present invention.

Although the wig and cap and hat stand described herein and its use with a hairdryer has been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents. No limitations are intended to the details of construction or design herein shown, other than as described in the claims below. While products and methods are described in terms of "comprising," "containing," "having," or "including" various components or steps, the products and methods can also "consist essentially of" or "consist of" the various components and steps. Whenever any numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined herein.

What is claimed is:

1. A portable wig and cap drying stand for use with a portable electric hair dryer comprising a bottom or fan section, a nozzle containing a heat source, and a handle with an electric switch, all in a hand gun style configuration, wherein the stand comprises:

a hollow base having sufficient depth and breadth and a hole to receive the bottom or fan section of the hair dryer for holding same in a position that causes the hair dryer to blow air in a vertical direction away from the base;

a wig support having an inverted bowl or dome shape with perforations for allowing flow of air; and a hollow cylinder for receiving the nozzle of the hair dryer and for connecting the base to the wig support; and wherein the base is cut out for the handle of the hair dryer such that the handle protrudes from the base when the bottom of the hair dryer is positioned in the base.

2. The stand of claim 1 wherein the cylinder connects to the base in such a manner that the handle of the hair dryer, or the portion of the handle of the hair dryer containing the switch, is external the stand when the hair dryer is positioned in the base for use.

3. The stand of claim 1 wherein the cylinder has perforations for allowing flow of air in and out of the cylinder.

4. The stand of claim 1 further comprising means for cooling the hair drying during operation.

5. The stand of claim 4 wherein the means for cooling the hair dryer comprises legs for resting the base on a surface while lifting the base off the surface sufficiently to allow air flow beneath the base.

6. The stand of claim 5 wherein the legs are three or four in number.

7. The stand of claim 4 wherein the means for cooling the hair dryer comprise vents in a side of the base.

8. The stand of claim 1 wherein the base comprises an adapter for accommodating receipt of various sizes of hair dryers.

9. The stand of claim 1 wherein the cylinder is collapsible for collapsing when not in use.

10. The stand of claim 9 wherein the cylinder is telescopic in design for accomplishing its collapsibility.

11. The stand of claim 9 wherein the cylinder is foldable for folding when not in use.

12. The stand of claim 9 wherein the wig support and the base are compatibly shaped such that the wig support fits over the base when not in use.

13. The stand of claim 12 wherein the cylinder is removable from the wig support and the base when not in use.

14. The stand of claim 12 wherein the cylinder collapses within the base when not in use.

* * * * *